US012721456B2

(12) United States Patent
Jang et al.

(10) Patent No.: US 12,721,456 B2
(45) Date of Patent: Sep. 1, 2026

(54) SHOE CARE APPARATUS

(71) Applicant: LG ELECTRONICS INC., Seoul (KR)

(72) Inventors: Ju Hyuck Jang, Seoul (KR); Ji Hun Kim, Seoul (KR); Yeon A Na, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 79 days.

(21) Appl. No.: 18/712,155

(22) PCT Filed: Dec. 7, 2022

(86) PCT No.: PCT/KR2022/019835
§ 371 (c)(1),
(2) Date: May 21, 2024

(87) PCT Pub. No.: WO2023/113364
PCT Pub. Date: Jun. 22, 2023

(65) Prior Publication Data

US 2025/0049234 A1 Feb. 13, 2025

(30) Foreign Application Priority Data

Dec. 17, 2021 (KR) ..... 10-2021-0181152
May 3, 2022 (KR) ..... 10-2022-0055070

(51) Int. Cl.

| | |
|---|---|
| ***A47F 7/08*** | (2006.01) |
| ***A47F 3/00*** | (2006.01) |
| ***A47F 3/04*** | (2006.01) |
| ***A47F 3/11*** | (2006.01) |
| ***A47L 23/20*** | (2006.01) |

(52) U.S. Cl.
CPC ..... *A47F 7/08* (2013.01); *A47F 3/001* (2013.01); *A47F 3/0434* (2013.01); *A47F 3/11* (2013.01); *A47L 23/20* (2013.01); *A47L 23/205* (2013.01)

(58) Field of Classification Search
CPC ..... A47L 23/20; A47L 23/205; A47B 61/04; A47F 7/08; A47F 3/001; A47F 3/005; A47F 3/0434; A47F 3/10; A47F 3/11; A47F 3/06; A47F 3/063
See application file for complete search history.

(56) References Cited

U.S. PATENT DOCUMENTS 2,898,171 A * 8/1959 Ehlert ..... A47F 3/063 312/223.5
2018/0127150 A1 5/2018 Adanur et al.
2021/0220496 A1 7/2021 An et al.

FOREIGN PATENT DOCUMENTS

CN 106724098 A * 5/2017 ..... A47L 23/205
CN 210114419 U 2/2020

(Continued)

*Primary Examiner* — Andrew Roersma
(74) *Attorney, Agent, or Firm* — Birch, Stewart, Kolasch & Birch, LLP

(57) ABSTRACT

A shoe care device having an accommodation space to accommodate shoes therein, includes a body; a moving body configured to form the accommodation space together with the body and coupled to the body so as to slide between a first location and a second location ahead of the first location; a blowing part configured to circulate air in the accommodation space; and a stopping part configured to limit the sliding movement of the moving body relative to the body within the second location.

14 Claims, 11 Drawing Sheets

(56) References Cited

FOREIGN PATENT DOCUMENTS

| | | | | | |
|---|---|---|---|---|---|
| CN | 111109872 | A | * | 5/2020 | ..... A47B 49/002 |
| CN | 111990783 | A | * | 11/2020 | ..... A47L 23/205 |
| CN | 212729206 | U | | 3/2021 | |
| CN | 113651015 | A | | 11/2021 | |
| JP | 4-136168 | U | | 12/1992 | |
| JP | H0835769 | A | * | 2/1996 | |
| JP | 2556033 | Y2 | | 12/1997 | |
| JP | 2010-156173 | A | | 7/2010 | |
| JP | 3186097 | U | | 9/2013 | |
| KR | 200438015 | Y1 | * | 1/2008 | ..... B60R 7/043 |
| KR | 1020100104292 | A | * | 9/2010 | |
| KR | 10-1091716 | B1 | | 12/2011 | |
| KR | 10-2013-0034367 | A | | 4/2013 | |
| KR | 1020140107876 | A | * | 9/2014 | |
| KR | 2020210000423 | U | * | 2/2021 | |
| KR | 102230674 | B1 | * | 3/2021 | ..... A47L 23/205 |

* cited by examiner

SHOE CARE APPARATUS

CROSS REFERENCE TO RELATED APPLICATIONS

This application is the National Phase of PCT International Application No. PCT/KR2022/019835, filed on Dec. 7, 2022, which claims priority under 35 U.S.C. 119 (a) to Patent Application Nos. 10-2021-0181152 and 10-2022-0055070, filed in the Republic of Korea on Dec. 17, 2021, and May 3, 2022, respectively, all of which are hereby expressly incorporated by reference into the present application.

TECHNICAL FIELD

The present invention relates to a shoe care device (shoe care apparatus), and more particularly, to a shoe care device that manages and displays shoes stored therein.

BACKGROUND ART

Only when shoes should be properly kept, the shoes can be worn for a long time without breaking the shape of the shoes. When the shoes are stacked in layers, the shape can be deformed. In general, a shoes cabinet is used for organization and keeping of the shoes.

In recent years, people who collect shoes of popular brands as part of hobby or financial tech have appeared, and a show case has been disclosed which is configured to keep and display the shoes.

US Patent Publication No. 2018-0127150 (hereinafter, referred to as 'Prior Art Document 1'), entitled, "Modular storage container", discloses a modular storage container including a housing, a door panel, a fan, and a light source.

According to Prior Art Document 1 above, the housing has a rectangular parallelepiped box shape having an opening on a front surface thereof. The housing has an accommodation space therein. The door panel opens/closes the opening of the housing, and is configured to be transparent or translucent.

In Prior Art Document 1 above, the fan is installed on a rear panel of the housing. When the fan rotates, air in the accommodation space is ventilated to outside air. An air duct is formed in the housing for an air flow between the outside air and the accommodation space. The light source is installed in an upper panel and illuminates the accommodation space.

According to Prior Art Document 1 above, since internal air of the container is configured to be ventilated to the outside air, a possibility that an internal environment (temperature and humidity) of the container will be influenced by an external environment (temperature and humidity) of the container increases. That is, it may be difficult to control the internal temperature and humidity of the container.

For example, according to Prior Art Document 1 above, since the internal air of the container is just ventilated to the outside air, the humidity of the accommodation space can be continuously maintained when the humidity of the outside air is high like the rainy season. The air may change a color and a shape of the shoe stored in the container, and act to cause the shoe to be contaminated by mold and bacteria which are easy to breed at high temperature and humidity.

As such, in that Prior Art Document 1 above does not consider a technology of maintaining the internal temperature and humidity of the container in an optimal state, there is a risk of deformation or contamination of the shoe in the process of using the container by a user.

Further, according to Prior Art Document 1 above, the inside of the container can be viewed only through a door panel, and the inside of the container cannot be viewed at a left side or a right side of the container, so there is a limit in increasing a display effect of the shoe.

In relation to a technology of displaying the shoes for a commercial purpose, Korean Patent Unexamined Publication No. 2013-0034367 (hereinafter, referred to as 'Prior Art Document 2') discloses a show case having transmissive display, and the resulting case is configured to include a show case body, a transparent display means, a turntable, a touch panel, and an LED.

The show case body has a space capable of storing products such as the shores therein. The transparent display means is installed on a front surface of the show case body. The products are seated on the turntable, and rotate inside the show-case body by the rotation of the turntable. The LED illuminates the products inside the show case body.

However, in that Prior Art Document 2 above does not consider a technology of controlling the internal temperature and humidity of the show case, there is a risk of deformation or contamination of the shoe in a state in which the show is stored inside the show case.

Further, according to Prior Art Document 2 above, the inside of the show case can be viewed only through the transparent display means, and the inside of the show case cannot be viewed at the left side or the right side of the show case, so there is a limit in increasing the display effect of the shoe.

Korean Patent Unexamined Publication No. 10-2000-0009653 (hereinafter, referred to as 'Prior Art Document 3') discloses a shoes cabinet for the sanitization, and the resulting shoes cabinet is configured to include a body, an infrared radiation unit, a circulation fan, an air circulation passage, a sanitization filter unit, etc.

Prior Art Document 3 above discloses that the shoes are dehumidified, sanitized, and deodorized by far infrared rays and filters while storing the shoes.

However, according to Prior Art Document 3 above, the shoes cannot be displayed.

As described above, conventional devices that accommodate the shoes therein have a limit in the care of the shoes and the display of the shoes.

As a result, in the development of a shoe care device, considering whether the display effect of the shoes can be maximized while constantly maintaining an environment of an internal space (hereinafter, referred to as 'accommodation space') of the shoe care device, whether the accommodation space can be easily opened and closed, whether the shoes can be effectively stored and withdrawn in a state in which the accommodation space is opened, whether structural stability of the shoe care device can be ensured in a state in which the accommodation space is maximally opened, etc., is required.

Moreover, it should be considered whether structural rigidity of a lowest shoe care device can be maintained for a long period even though the shoe care devices are stacked in multiple layers, whether electrical stability can be effectively guaranteed even though the shoe care device is used for a long period, whether an interior effect by the shoe care device can be maximized in addition to the display effect of the shoe, whether internal components are appropriately arranged in a limited space, whether use convenience is excellent, etc., should also be considered, and the development of the shoe care device considering all of the points is required.

DISCLOSURE

Technical Problem

The present disclosure is intended to solve the above problems with the shoe care device that accommodates shoes therein.

Specifically, the present disclosure is intended to provide a shoe care device capable of meeting the needs of users who always wish to store and maintain their shoes in the best condition by obtaining both the shoe display effect of displaying shoes and the shoe care effect of preventing deformation or contamination of shoes.

In addition, the present disclosure is intended to provide a shoe care device with a structure that allows the accommodation space in which shoes are accommodated to be easily opened and closed, thereby effectively enabling placement and removal of shoes in the state in which the accommodation space is open.

In addition, the present disclosure is intended to provide a shoe care device capable of maintaining a stable state even if the accommodation space is sufficiently opened for the placement and removal of shoes by limiting the degree of opening of the accommodation space within a predetermined range.

The technical problems to be solved by the present disclosure are not limited to the technical problems mentioned above, and other technical problems not mentioned will be clearly understood by those skilled in the art to which the present disclosure belongs from the description below.

Technical Solution

In order to attain the above or other purposes, a shoe care device according to one aspect of the present disclosure is configured to appropriately maintain the environment of the accommodation space, as well as to accommodate shoes in an accommodation space and display the shoes to be isolated from the outside. Specifically, it may be configured to accommodate shoes in the accommodation space formed by both the body and moving body, switch to a closed state to display the shoes, and, at the same time, circulate air in the accommodation space through the blowing part, thereby adjusting the condition of the accommodation space.

In addition, the shoe care device according to one aspect of the present disclosure is configured to easily open and close the accommodation space through relative movement between elements constituting the accommodation space. Specifically, the moving body is configured to be slidably coupled to the body and move between the first location and the second location, thereby opening and closing the accommodation space.

In addition, the shoe care device according to one aspect of the present disclosure is configured such that the accommodation space is opened within a range capable of maintaining a stable state. Specifically, the sliding movement of the moving body relative to the body is configured to be limited so as not to exceed the second location by the stopping part.

In addition, the shoe care device according to one aspect of the present disclosure is able to control the condition of the accommodation space by heating the air in the accommodation space by a heating part.

In addition, the shoe care device according to one aspect of the present disclosure may be configured such that the body includes an upper body, a lower body, and a middle body, and such that the moving body includes a base and a transparent window.

In addition, the shoe care device according to one aspect of the present disclosure may be configured such that a first fin portion formed in the transparent window engages with a first stopper formed in the upper body, so that the moving body may slide relative to the body.

In addition, the shoe care device according to one aspect of the present disclosure may be configured such that a first window, a second window, and a third window of the transparent window are integrally formed.

In addition, the shoe care device according to one aspect of the present disclosure may have a first stopper and a second stopper formed symmetrically on both sides.

In addition, in the shoe care device according to one aspect of the present disclosure, a hooking portion formed on the base may engage with a hooking groove formed on the lower body, thereby performing sliding movement of the moving body relative to the body.

In addition, the shoe care device according to one aspect of the present disclosure may be configured such that a pair of hooking portions and hooking grooves are formed to be symmetrical on both sides.

In addition, the shoe care device according to one aspect of the present disclosure may have a turntable disposed on the lower surface of the accommodation space so as to rotate around a vertical axis.

In addition, in the shoe care device according to one aspect of the present disclosure, the rotation axis of the turntable may be located ahead of the front end of the body in the open state.

In addition, the shoe care device according to one aspect of the present disclosure may be configured such that a frame body is coupled to the body to have a shape connecting the upper, lower, and rear surfaces of the body to each other, thereby supporting the body.

In addition, the shoe care device according to one aspect of the present disclosure may be formed by bending a member in which a frame body including an upper frame, a lower frame, and a middle frame is formed to extend in the longitudinal direction.

The solutions to the technical problems to be solved in the present disclosure are not limited to the solutions mentioned above, and other solutions not mentioned may be clearly understood by those skilled in the art to which the present disclosure pertains from the description below.

MODES FOR THE INVENTION

Figure 1A:
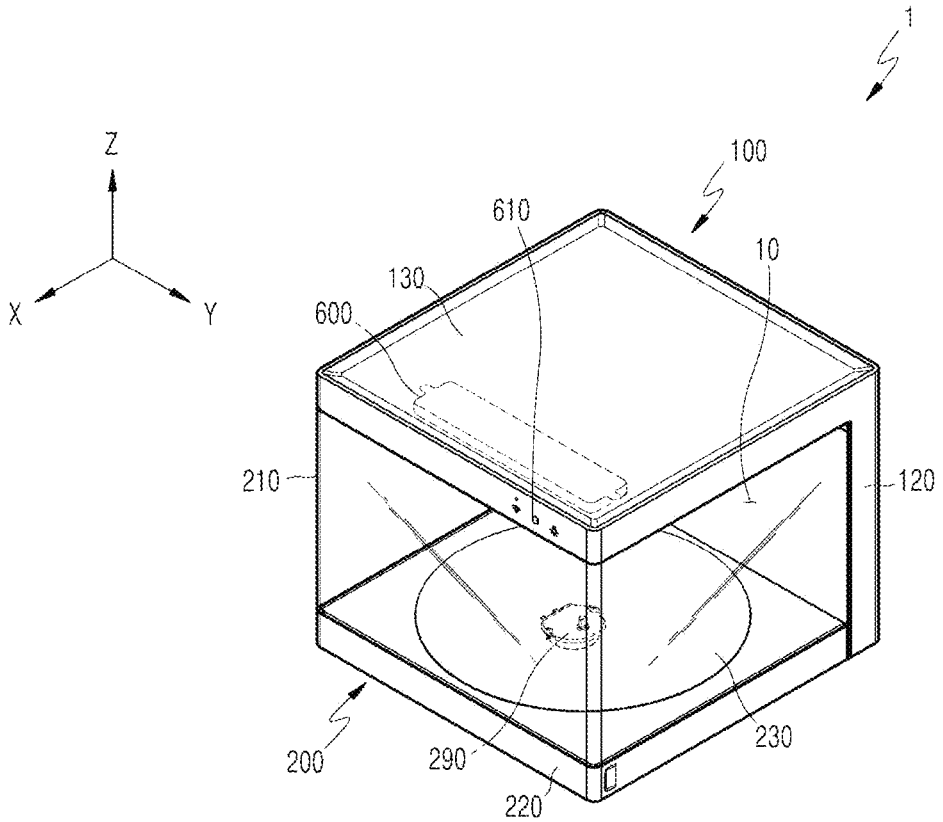
FIG. 1*a* is a perspective view illustrating a shoe care device according to an embodiment of the present invention.

Hereinafter, embodiments disclosed in this specification will be described in detail with reference to the accompanying drawings and the same or similar components are denoted by the same or similar reference numerals, and duplicated description thereof will be omitted. Suffixes "module" and "unit" for components used in the following description are given or mixed in consideration of easy preparation of the present invention only and do not have their own distinguished meanings or roles. Further, in describing the embodiment disclosed in this specification, a detailed description of related known technologies will be omitted if it is determined that the detailed description makes the gist of the embodiment disclosed in this specification unclear. Further, it is to be understood that the accompanying figures are just used for easily understanding the embodiments disclosed in this specification and a technical spirit disclosed in this specification is not limited by the accompanying figures and all changes, equivalents, or substitutes included in the spirit and the technical scope of the present invention are included.

Terms including an ordinary number, such as first and second, are used for describing various elements, but the elements are not limited by the terms. The terms are used only to discriminate one element from another element.

It should be understood that, when it is described that a component is "connected to" or "accesses" another component, the component may be directly connected to or access the other component or a third component may be present therebetween. In contrast, when it is described that a component is "directly connected to" or "directly accesses" another component, it is understood that no element is present between the element and another element.

A singular form includes a plural form if there is no clearly opposite meaning in the context.

In the present application, it should be understood that term "include" or "have" indicates that a feature, a number, a step, an operation, a component, a part or the combination thereof described in the specification is present, but does not exclude a possibility of presence or addition of one or more other features, numbers, steps, operations, components, parts or combinations thereof, in advance.

When the shoe is directly exposed to dust, water, heat, and/or sunshine, a fiber material of the shoe may be damaged over time, and a color and a form of the shoe may be changed.

In order to keep the shoe in an original state (e.g., a state of the shoe at the time of purchase or a state of a clean shoe) for a long time, the shoe should not be exposed much to light and the shoe should be kept at a place that is not too cold or hot. Further, the shoe needs to be kept at a place at which a temperature and a humidity are appropriately maintained.

Since the shoe made of a leather or suede material is easily colored or has mold, the shoe should be kept in an environment where temperature and humidity are appropriately maintained. A mothball acquired by solidifying pesticides and fragrances have a unique chemical smell that makes it difficult to remove because the smell permeates the shoe when the mothball is kept jointly with the shoe.

Further, when the shoes are stacked in layers, the form of the shoe may be changed by an applied load.

Meanwhile, as described above, in recent years, users who collect shoes of popular brands as part of a hobby or financial tech has increased, and the care of the shoe and the display of the shoe has become important needs of users.

Considering the points, a shoe care device according to an embodiment of the present invention is configured to safely keep the shoe, establish and adjust an environment (e.g., a predetermined range of temperature, humidity, etc.) required for each shoe, and effectively display the shoe, and increase use convenience of the user.

A first direction X, a second direction Y, and a third direction Z described in the embodiment of the present invention may be directions orthogonal to each other.

The first direction X and the second direction Y may be directions parallel to a horizontal direction, and the third direction Z may be a direction parallel to a vertical direction. When the first direction X is a direction parallel to the front and rear direction, the second direction Y may be a direction parallel to a left and right direction.

In describing embodiments of the present invention, except for a case which is particularly differently limited, the first direction X, the second direction Y, and the third direction Z may be appreciated as a front direction, a left direction, and an upper direction, respectively.

Figure 1B:
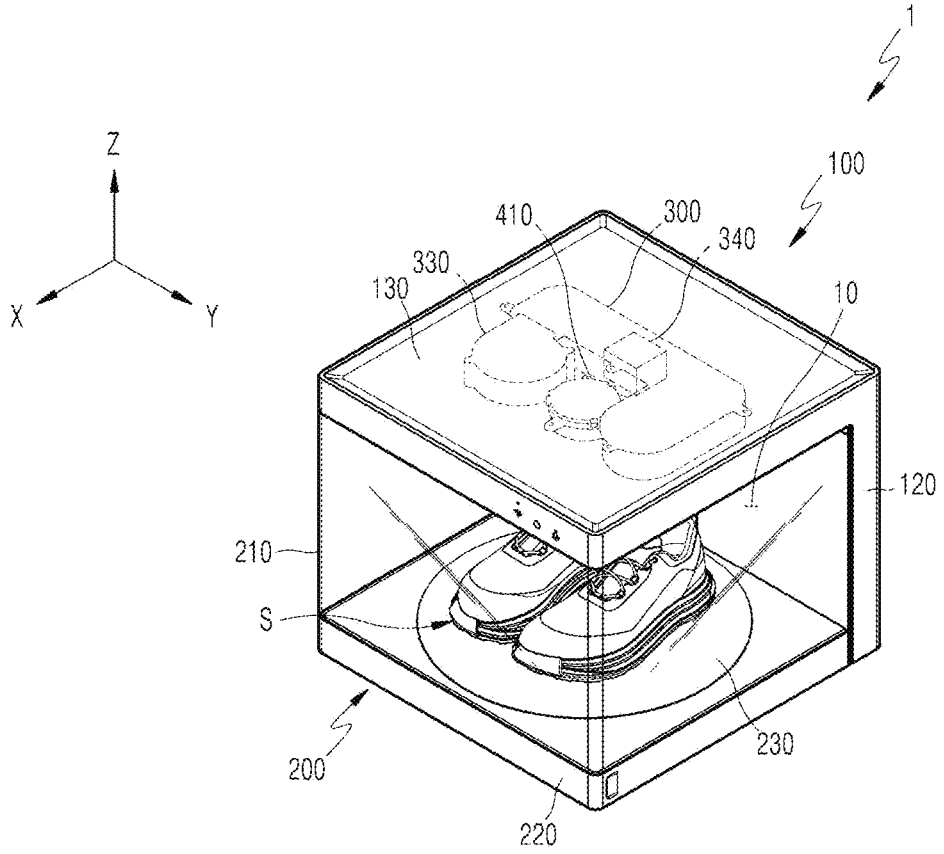
FIG. 1*b* is a perspective view illustrating a state in which a shoe is stored in an accommodation space of the shoe care device of FIG. 1*a*.

FIG. 1*a* is a perspective view illustrating a shoe care device 1 according to an embodiment of the present invention. FIG. 1*a* illustrates a state in which an internal space (hereinafter, referred to as 'accommodation space 10') of the shoe care device 1 is closed. FIG. 1*b* is a perspective view illustrating a state in which a shoe S is stored in the accommodation space 10 of the shoe care device 1 of FIG. 1*a*.

Figure 2A:
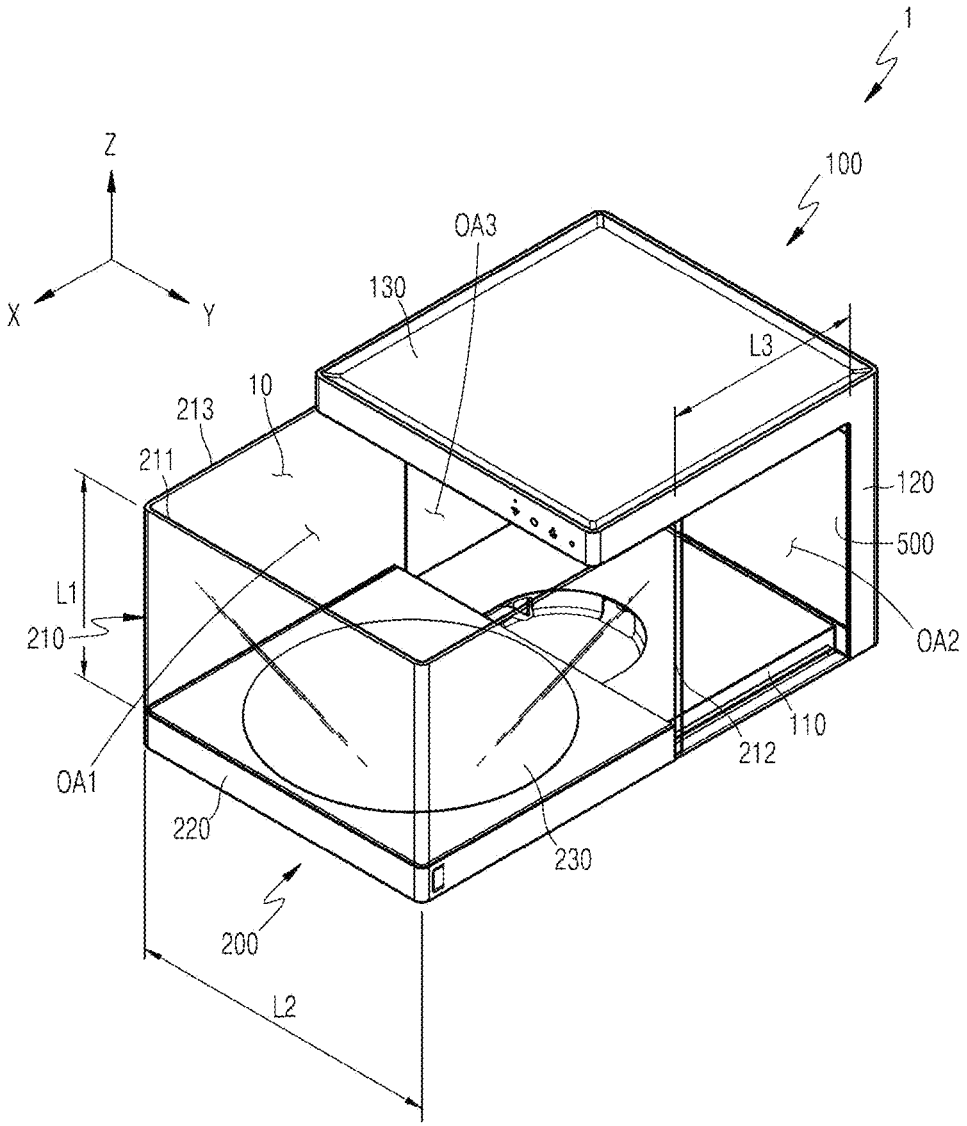
FIG. 2*a* is a perspective view illustrating a state in which the accommodation space of the shoe care device of FIG. 1*a* is opened.
Figure 2B:
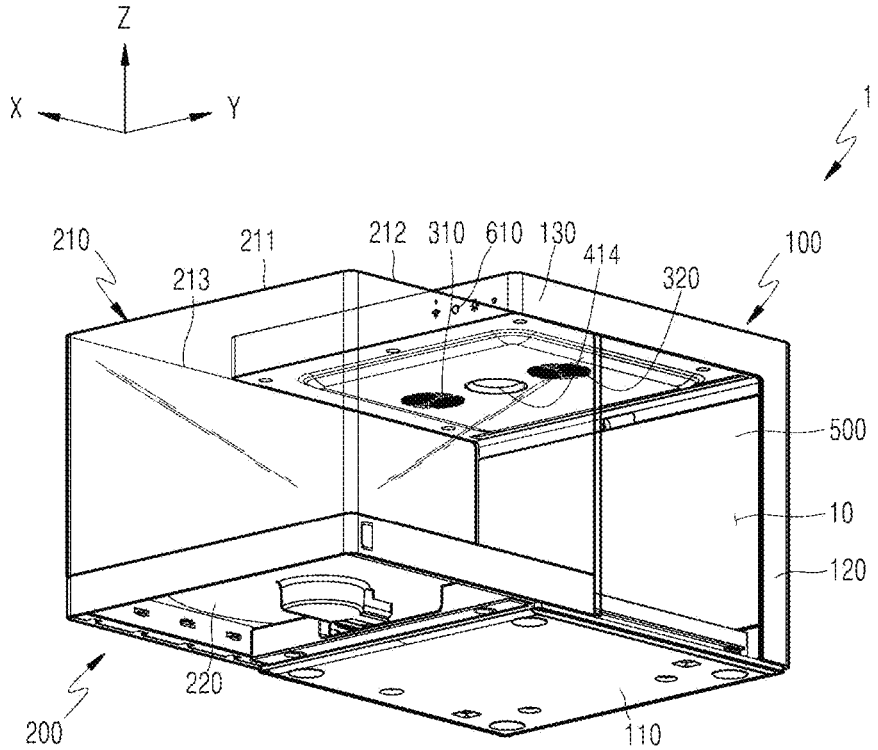
FIG. 2*b* is a perspective view illustrating a view of the shoe care device of FIG. 2*a* viewed in another direction.

FIG. 2*a* is a perspective view illustrating a state in which the accommodation space 10 of the shoe care device 1 of FIG. 1*a* is opened. FIG. 2*b* is a perspective view illustrating a view of the shoe care device of FIG. 2*a* viewed in another direction.

As illustrated, I FIGS. 1*a* and 1*b*, the shoe care device 1 according to the embodiment is configured to include a body 100 and a moving body 200.

The body 100 and the moving body 200 form the accommodation space 10 accommodating the shoe S jointly. The body 100 and the moving body 200 are coupled to move with respect to each other. The moving body 200 may be coupled to the body 100 to reciprocally move in a horizontal direction.

The shoe care device 1 illustrated in FIG. 1*a* may be changed like the shoe care device 1 illustrated in FIG. 2*a*. That is, the moving body 200 may slidably move in a first direction X with respect to the body 100, and the shoe care device 1 is transformed from the closed state to the opened state, and the accommodation space 10 may be opened.

The shoe care device 1 illustrated in FIG. 2*a* may be changed like the shoe care device 1 illustrated in FIG. 1*a* again. That is, the moving body 200 may slidably move in an opposite direction to the first direction X with respect to the body 100, and the shoe care device 1 is transformed from the opened state to the closed state, and the accommodation space 10 may be closed.

As such, in the shoe care device 1 according to the embodiment of the present invention, the moving body 200 may move the first direction X or the opposite direction to the first direction X with respect to the body 100, and reciprocally move in front and rear directions.

In the state in which the accommodation space 10 is closed, the accommodation space 10 may be sealed from outside air. Therefore, when the shoe S is accommodated in the accommodation space 10 and the accommodation space 10 is closed, a contact of the shoe S with dust and moisture of the outside air may be interrupted.

The body 100 may form an upper surface and a rear surface of the accommodation space 10.

The moving body 200 may form a front surface, a lower surface, and both side surfaces of the accommodation space 10.

The accommodation space 10 may be formed in a hexahedral form. However, the accommodation space 10 of the shoe care device 1 according to the embodiment of the present invention is not limited to such a shape, and may be configured in various three-dimensional shapes.

The body 100 and the moving body 200 may form an overall appearance of the shoe care device 1. An exterior of the shoe care device 1 may be configured in the hexahedral form. That is, in the state in which the body 100 and the moving body 200 are coupled to each other and the accommodation space 10 is closed, the external appearance of the shoe care device 1 may be configured in the hexahedral form. However, the shoe care device 1 according to the embodiment of the present invention is not limited to such a shape, and may be configured in various three-dimensional shapes.

The body 100 may include an upper body 130, a middle body 120, and a lower body 110.

The upper body 130 is positioned at an upper side of the accommodation space 10. The upper body 130 forms the upper surface of the accommodation space 10. The upper body 130 may form an uppermost portion of the shoe care device 1. The upper surface of the upper body 130 may form a flat surface along a substantially horizontal surface. When a plurality of shoe care devices 1 is provided, any one shoe care device 1 may be placed on the upper surface of the upper body 130 of the other one shoe care device 1, and the shoe care devices 1 may be stacked on each other.

The lower body 110 is positioned below the accommodation space 10. The lower body 110 may form a lowermost portion of the shoe care device 1. The lower body 110 may form a bottom portion of the shoe care device 1.

The middle body 120 is positioned behind the accommodation space 10. The middle body 120 forms the rear surface of the accommodation space 10. The middle body 120 may connect the upper body 130 and the lower body 110 behind the accommodation space 10. The middle body 120 may form a rear wall surface of the shoe care device 1.

The body 100 is configured to include the upper body 130, the middle body 120, and the lower body 110, and as a result, the body 100 may form a substantially 'C' form on the side view.

As described above, the moving body 200 is configured to move forward and backward with respect to the body 100. The moving body 200 may include a base 220, a transparent window 210, and a turntable 230.

The base 220 may be coupled to the lower body 110 to be slidably movable in the first direction X. The base 220 may form the bottom portion of the moving body 200. The base 220 may be positioned at the upper side of the lower body 110. A bottom surface of the base 220 may be positioned in close contact with or in proximity to the upper surface of the lower body 110.

The transparent window 210 may form of extending upward from the base 220. The transparent window 210 may form the front surface, and both side surfaces (a left surface and a right surface) of the accommodation space 10. The transparent window 210 may be made of a transparent or translucent material.

Light inside and outside the accommodation space 10 may pass through the transparent window 210. The transparent window 210 may be made of a material which is weather-resistant to prevent discoloration. The transparent window 210 may be made of an acrylic (PMMA) material which is weather-resistant and scratch-resistant.

The transparent window 210 may prevent a beam having a predetermined wavelength from being introduced into the accommodation space 10. As an example, the transparent window 210 may be configured to block ultraviolet rays. The ultraviolet rays as an electromagnetic wave in which a wavelength corresponds to 10 to 397 nm shorter than visible rays are light which has a strong chemical action and causes getting sunburn or discoloration.

As an example, an ultraviolet-proof film may be attached to an inner surface or an outer surface of the transparent window 210. Alternatively, the inner surface or the outer surface of the transparent window 210 may be UV-coated with an ultraviolet-proof agent.

The transparent window 210 includes a first window 211, a second window 212, and a third window 213. The first window 211 may form the front surface of the accommodation space 10. The second window 212 may form the left surface of the accommodation space 10. The third window 213 may form the right surface of the accommodation space 10.

In the state in which the shoe S is accommodated in the accommodation space 10, a user may view the shoe S through the transparent window 210. As a result, the shoe care device 1 may be used as a device which may display the shoe S while keeping and caring the shoe S.

As illustrated in FIGS. 1*a* and 1*b*, in the state in which the moving body 200 is positioned relatively at a rearmost side, the accommodation space 10 may be sealed from the outside air. In this case, the accommodation space 10 may be formed in the hexahedral form. In this case, the moving body 200 may be present at a first location and the shoe care device 1 is in the closed state.

As illustrated in FIGS. 2*a* and 2*b*, in the state in which the moving body 200 moves in the first direction X, the accommodation space 10 may be opened. In this case, an upper portion of the first window 211 is spaced to a front side in the first direction X from the front surface of the upper body 130 to form a gap (hereinafter, referred to as 'first gap').

In this case, an upper portion of the first window 212 is spaced to a front side in the first direction X from the front surface of the upper body 120 to form a gap (hereinafter, referred to as 'first gap'). The third window 213 is spaced to the front side in the first direction X from a right side surface of the middle body 120 to form a gap (hereinafter, referred to as 'third gap').

In the state in which the moving body 200 moves in the first direction X as much as possible, i.e., in the state in which the moving body 200 is positioned relatively at a frontmost side, the moving body 200 may be present at a second location and the shoe care device 1 may be in the opened state.

The user may put the shoe S into the accommodation space 10 or withdraw the shoe S from the accommodation space 10 through the first gap. The user may put the shoe S into the accommodation space 10 or withdraw the shoe S from the accommodation space 10 through the first gap. An internal panel 500 may be coupled to the inner surface of the middle body 120 or uncoupled from the inner surface of the middle body 120.

The turntable 230 may form the upper surface on which the shoe S is placed. The upper surface of the turntable 230 may have a circular shape. The turntable 220 may form the lower surface of the accommodation space 10 jointly with the base 220.

The turntable 230 may be rotatably coupled to the base 220 around a vertical axis, i.e., an axis parallel to a third direction Z.

For the rotation of the turntable 230, a motor 290 may be provided in the moving body 200. The motor 290 may be coupled to the base 220. The turntable 230 may rotate in conjunction with the rotation of the motor 290. Rotational force of the motor 290 may be delivered to the turntable 230 through a reducer. The motor 290 may rotate unidirectionally or reciprocally rotate bidirectionally.

The turntable 230 is provided, and as a result, the shoe S may rotate in the accommodation space 10 or a display effect of the shoe S may be enhanced.

The shoe care device 1 may include an operating button 610 and a controller 600. The operating button 610 may be formed in the body 100. As an example, the operating button 610 may be formed on the front surface of the upper body 130. When the user manipulates the operating button 610, the turntable 230 may rotate or stop. The user manipulates the operating button 610 to adjust a rotational speed of the turntable 230. The user may input a rotation time of the turntable 230 into the controller 600 through the operating button 610.

The user manipulates the operating button 610 to rotate the turntable 230 at a predetermined angle. In the state in which the accommodation space 10 is opened, the user may place the shoe S on the upper surface of the turntable 230 by holding any one part (heel top, lining, tong, etc.) of the shoe S. Thereafter, the user manipulates the operating button 610 to rotate the turntable 230 at a predetermined angle.

As an example, the user manipulates the operating button 610 to rotate the turntable 230 at a predetermined angle so that a front and rear direction of the shoe S coincides with the first direction X. Alternatively, the user manipulates the operating button 610 to rotate the turntable 230 at a predetermined angle so that the front and rear direction of the shoe S form a predetermined angle with the first direction X.

Therefore, even though the user places the shoe S on the upper surface of the turntable 230 while gripping any one part of the shoe S, the shoe S may be placed (displaced) in a direction desired by the user.

A sensor (not illustrated) that senses movement of the moving body 200 may be provided in the body 100. When the accommodation space 10 is closed, the controller 600 may rotate the turntable 230 by a signal of the sensor.

A load sensor (not illustrated) may be provided in the base 220. The load sensor may automatically measure a load of the shoe S placed on the turntable 230. The rotational speed of the turntable 230 according to a measurement value of the load sensor may be set in the controller 600. Alternatively, the user may input the rotational speed of the turntable 230 according to the measurement value of the load sensor into the controller 600 through the operating button 610.

A camera (not illustrated) may be provided in the shoe care device 1. The camera may automatically shoot the shoe S placed on the turntable 230. The controller 600 may recognize the shape, size, and/or type of the shoe S through a shooting image of the camera.

The rotational speed of the turntable 230 according to the shape, size, and/or type of the shoe S may be set in the controller 600. Alternatively, the user may input the rotational speed of the turntable 230 according to the shape, size, and/or type of the shoe S into the controller 600 through the operating button 610.

The shoe care device 1 may include an operating sensor. The operating sensor may sense an access of the user. The turntable 230 may be rotated or stopped by the sensing signal of the operating sensor.

Figure 3A:
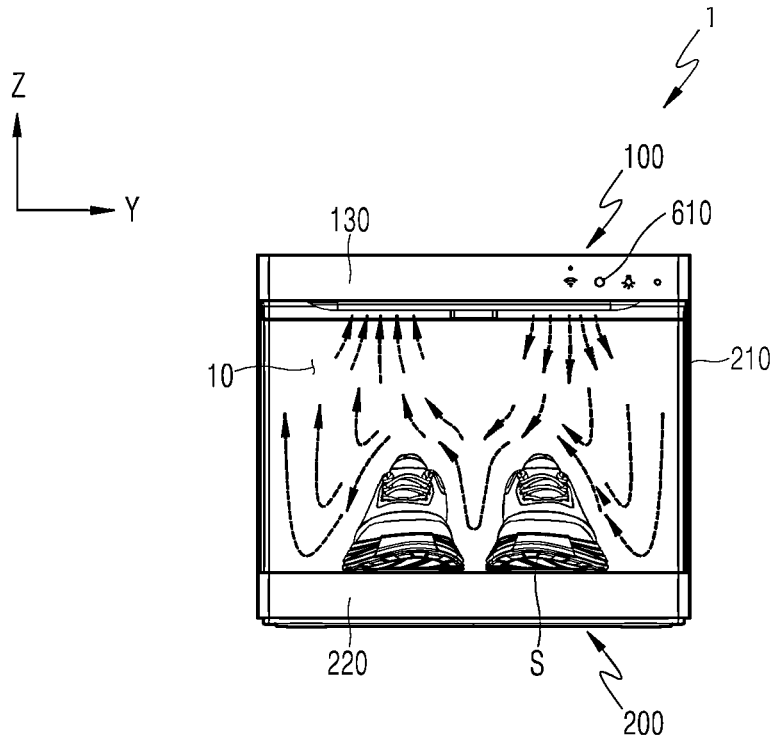
FIG. 3*a* is a side view illustrating a use state of the shoe care device of FIG. 1*b*.

FIG. 3*a* is a side view illustrating a use state of the shoe care device 1 of FIG. 1*b*. FIG. 3*a* illustrates a state of illuminating the shoe S in the accommodation space 10.

Figure 3B:
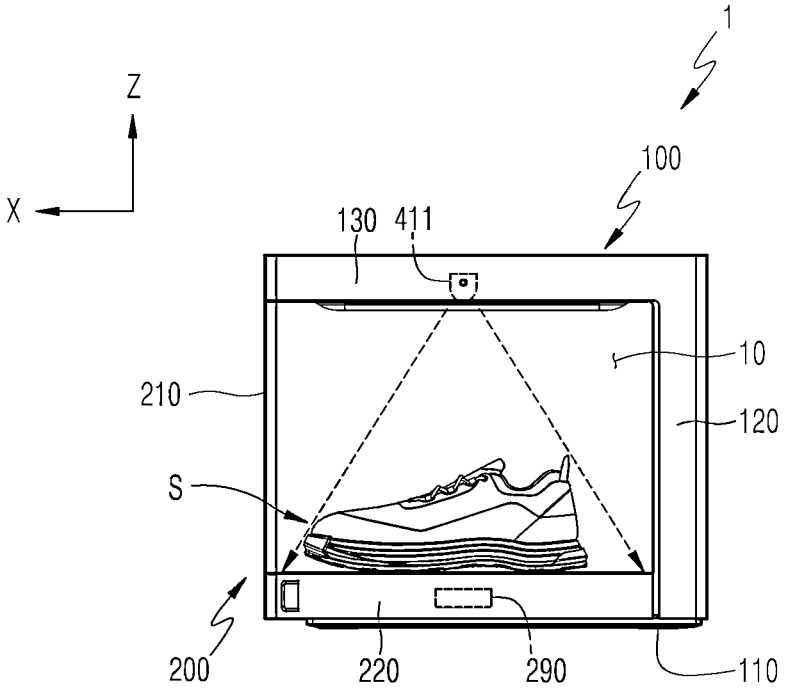
FIG. 3*b* is a front view illustrating the use state of the shoe care device of FIG. 1*b*.

FIG. 3*b* is a front view illustrating the use state of the shoe care device 1 of FIG. 1*b*. FIG. 3*b* illustrates an air flow in the accommodation space 10.

The shoe care device 1 according to the embodiment of the present invention may include a first light 410. The first light 410 may be provided in the upper body 130.

As illustrated in FIG. 3*a*, the first light 410 may illuminate the accommodation space 10. The first light 410 may include a light source 411 and a lens 414.

The light source 411 may intensively irradiate light onto the upper surface of the turntable 230 on which the shoe S is placed. The light of the light source 411 may intensively illuminate the shoe S placed on the upper surface of the turntable 230. When the light 410 is turned, an image of the shoe S stored in the accommodation space 10 may be changed by the light of the light source 411.

The light of the light source 411 may illuminate the accommodation space 10 by passing through the lens 414. An ultraviolet-proof film may be attached to the lens 414 or the ultraviolet-proof agent may be coated on the lens 414 in order to block the ultraviolet rays.

When the user manipulates the operating button 610, the light source 411 may be turned on or off. The user may input an operating time of the light source 411 into the controller 600 through the operating button 610. The user manipulates the operating button 610 to adjust the operating time of the light source 411.

Alternatively, the light source 411 may be turned on or off by the sensing signal of the operating sensor. The controller 600 may turn on-off the light source by the signal of the operating sensor.

Alternatively, the light source 411 may be turned on or off by the sensing signal of the sensor. When the accommodation space 10 is closed, the controller 600 may turn on-off the light source by the signal of the sensor.

Alternatively, the operating time and the operating pattern of the light source according to the measurement value of the load sensor may be set in the controller 600. The user may input the operating time and the operating pattern of the light source 411 according to the measurement value of the load sensor into the controller 600 through the operating button 610.

Alternatively, the operating time and the operating pattern of the light source according to the shape, size, and/or type of the shoe S may be set in the controller 600. The user may input the operating time and the operating pattern of the light source 411 according to the shape, size, and/or type of the shoe S into the controller 600 through the operating button 610.

The light source 411 may be configured to change the color of the light. As an example, the light source 411 may be constituted by Red Green Blue White (RGBW) LEDs. The controller 600 may control current applied to a Red (R) LED, a Green (G) LED, a Blue (B) LED, and a White (W) LED. When the controller 600 controls the current applied to the RGBW LEDs, the aesthetics and a color sense of the shoe S stored in the accommodation space 10 may be variously changed. The user may input a pattern of the current applied to the RGBW LED into the controller 600 through the operating button 610.

Figure 4:
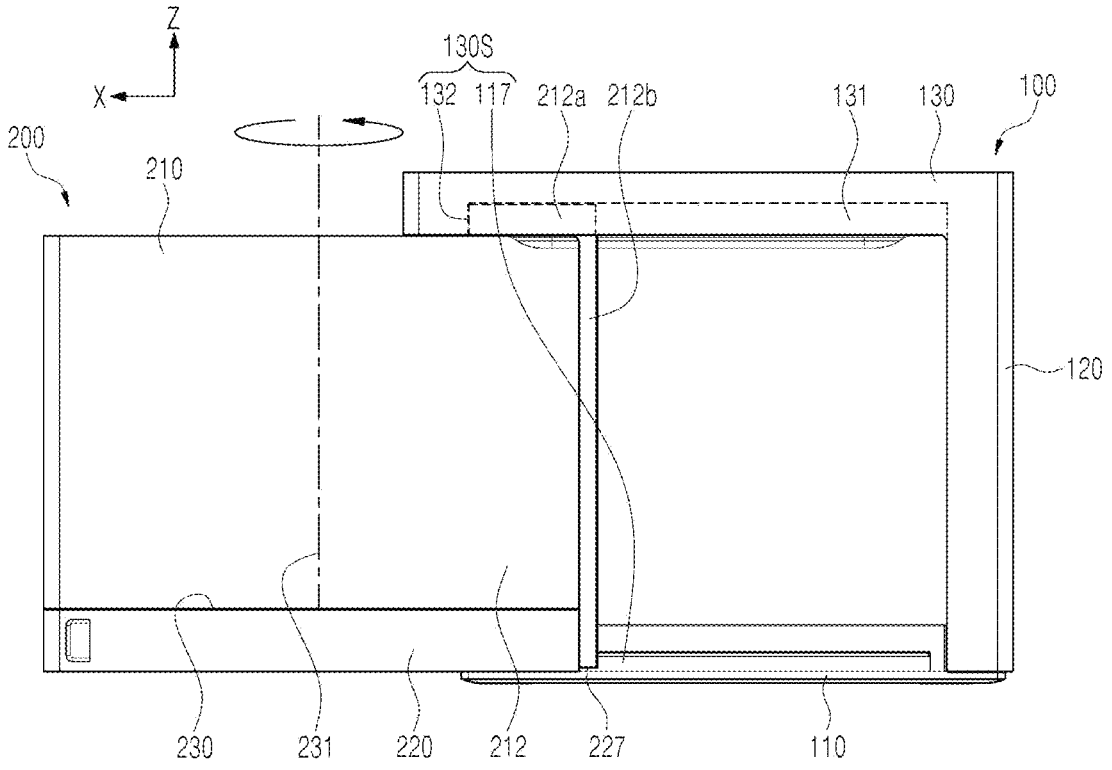
FIG. 4 is a diagram illustrating the stopping part in the opened state of the shoe care device according to an embodiment of the present invention.
Figure 5:
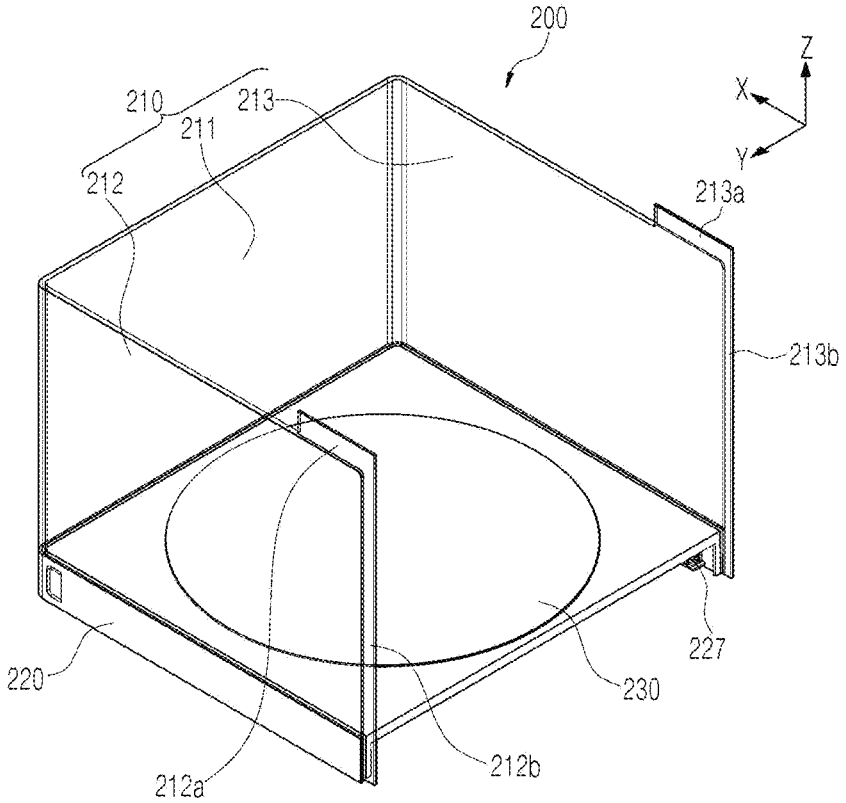
FIG. 5 is a diagram illustrating the transparent window of the moving body in the shoe care device according to an embodiment of the present invention.
Figure 6:
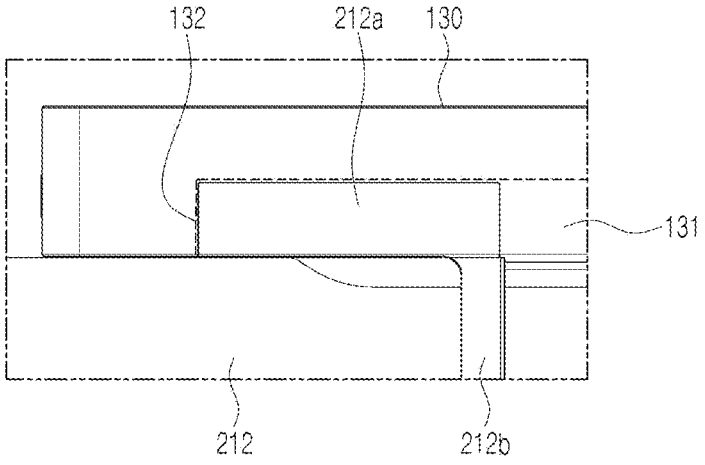
FIG. 6 is a diagram illustrating the first fin portion and the first stopper in the shoe care device according to an embodiment of the present invention.
Figure 7:
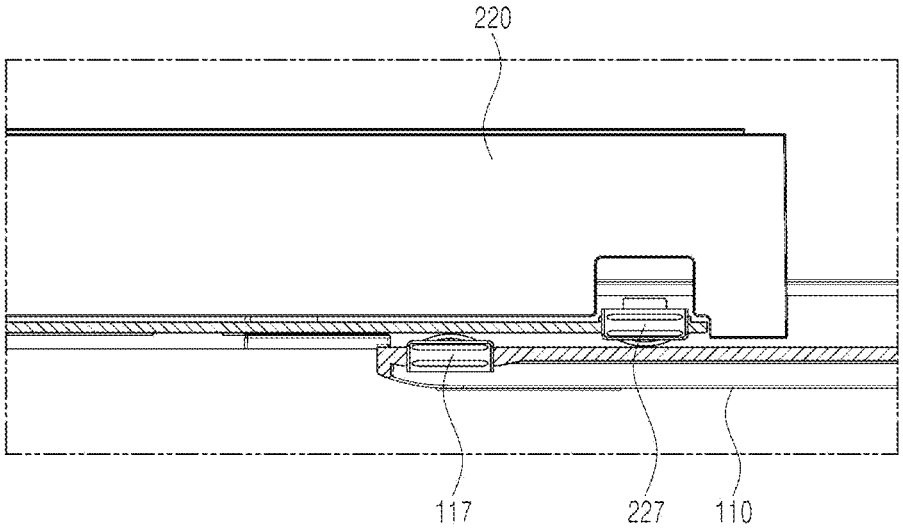
FIG. 7 is a diagram illustrating a hooking portion and a hooking groove in the shoe care device according to an embodiment of the present invention.

FIG. 4 is a diagram illustrating the stopping part 130*s* in the opened state of the shoe care device 1 according to an embodiment of the present invention. FIG. 5 is a diagram illustrating the transparent window 210 of the moving body 200 in the shoe care device 1 according to an embodiment of the present invention. FIG. 6 is a diagram illustrating the first fin portion 212*a* and the first stopper 132 in the shoe care device 1 according to an embodiment of the present invention. FIG. 7 is a diagram illustrating a hooking portion 227 and a hooking groove 117 in the shoe care device 1 according to an embodiment of the present invention.

According to an embodiment of the present invention, the shoe care device 1 may include the body 100, the moving body 200, the blowing part 330, and the stopping part 130*s*.

The body 100 as a part that forms a part of the accommodation space 10 may constitute a reference location for the moving body 200 which slidably moves.

The moving body 200 is a part that forms the accommodation space 10 jointly with the body 100, and is coupled to the body 100 to slidably move between the first location and the second location in front of the first location.

The blowing part 330 as a part configured to circulate the air in the accommodation space 10 may allow the shoe accommodated in the accommodation space 10 to be paced in an appropriate environment by adjusting an air state (in particular, humidity) of the accommodation space 10.

The stopping part 130*s* as a part configured to restrict the sliding movement of the moving body 200 with respect to the body 100 within the second location may restrict the moving body 200 to excessively move forward with respect to the body 100 when the opened state of the shoe care device 1 is switched to the opened state.

In order to easily put the shoe into the accommodation space 10 or easily withdraw the shoe from the accommodation space 10 in the opened state of the shoe care device 1, the moving body 200 needs to sufficiently move forward with respect to the body 100.

However, when the moving body 200 excessively moves to the front of the body 100, the center of gravity of the moving body 200 is positioned in front of the front end of the body 100, and as a result, there is a risk that the shoe care device 1 will be reversed as a whole.

Further, when the moving body 200 excessively moves to the front of the body 100, the moving body 200 and the body 100 are separated, so there is a risk that the shoe care device 1 will be damaged or the usability will be lowered.

Therefore, it may be preferable to restrict the sliding movement of the moving body 200 not to cross the second location when switching the opened state of the shoe care device 1.

As such, in the shoe care device 1 according to the embodiment, since the stopping part 130*s* restricts the sliding movement of the moving body 200 with respect to the body 100 not to cross the second location, it is possible to prevent separation of the body 100 and the moving body 200 or a reverse which occurs due to a change in center of gravity when the moving body 200 excessively moves for the opened state.

The shoe care device 1 according to an embodiment of the present disclosure may further include a heating part 340 configured to heat the air circulating in the accommodation space 10.

That is, the heating part 340 may be configured to transfer heat energy to the circulating air to control the air condition (particularly, temperature and/or humidity) in the accommodation space 10 such that the shoes accommodated in the accommodation space 10 are in the proper environment.

In this way, the shoe care device 1 according to the present embodiment may adjust the condition of the accommodation space 10 by heating the air in the accommodation space 10 through the heating part 340, thereby maintaining the environment of the accommodation space 10 appropriately to more effectively care for shoes.

In the shoe care device 1 according to an embodiment of the present disclosure, the body 100 may be configured to include an upper body 130 forming the upper surface of the accommodation space 10, a lower body 110 located below the accommodation space 10, and a middle body 120 that connects the rear sides of the upper body 130 and the lower body 110 to form the rear surface of the accommodation space 10.

In addition, the moving body 200 may be configured to include a base 220 slidably coupled to the lower body 110 and a transparent window 210 that extends to the upper part of the base 220 and forms the front surface and both side surfaces of the accommodation space 10.

In this case, the body 100, which is a combination of the lower body 110, the middle body 120, and the upper body 130, may be formed in a "⊏" shape when viewed from the side. Accordingly, this body 100 may form three sides of the shoe care device 1 in three-dimensional space.

In addition, the transparent window 210 placed on the base 220 may form the remaining three sides of the shoe care device 1 in three-dimensional space.

Accordingly, the accommodation space 10 may be formed between the body 100 and the moving body 200 in the closed state, and if the moving body 200 slides forward from the body 100, a gap may be formed between the body 100 and the moving bodies 200 for placing and removing shoes.

In addition, in the state where the shoe care device 1 is open, the lower body 110 of the body 100 and the base 220 of the moving body 200 are in the connected state with each other, and the upper body 130 of the body 100 and the side portion of the transparent window 210 of the moving body 200 are in the connected state with each other.

That is, even when the shoe care device 1 is open, the body 100 and the moving body 200 may be connected to each other at the lower and upper sides. This connection structure may maintain a stable structure even when the shoe care device 1 is open.

As described above, in the shoe care device 1 according to the present embodiment, since the body 100 includes the upper body 130, the lower body 110, and the middle body 120, and since the moving body 200 includes the base 220 and the transparent window 210, the connection structure between the body 100 and the moving body 200 may be maintained stably during the sliding movement of the moving body 200 relative to the body 100.

In the shoe care device 1 according to an embodiment of the present invention, the first fin portion 212*a* of which a part is projected upward may be formed at the upper portion of the part forming one side surface of the accommodation space 10 in the transparent window 210.

In addition, the stopping part 130*s* may be configured to include a first stopper 132 which is formed on one side surface of the upper body 130 spaced apart from the front end of the upper body 130, and engages with the first fin portion 212*a* upon the sliding movement of the moving body 200 with respect to the body 100.

That is, the first fin portion 212*a* may be formed the transparent window (210) part forming the side surface of the accommodation space 10, which is projected upward. The first fin portion 212 may maintain the engaged state with the first insertion groove 131 formed on the side surface of the upper body 130.

Therefore, in the process in which the shoe care device 1 is switched to the closed state and the opened state, the first fin portion 212*a* of the transparent window 210 may slidably move while engaging with the first insertion groove 131 of the upper body 130.

As a result, a left-right direction clearance between the transparent window 210 and the body 100 may be appropriately prevented in the process of the sliding movement of the moving body 200 with respect to the body 100.

Further, since the first stopper 132 is formed at the portion spaced apart from the front end of the upper body 130, a range of the first fin portion 212*a* engaging with the first stopper 132, which may move to the front of the body 100 may be restricted.

As such, in the shoe care device 1 according to the embodiment, since the first fin portion 212*a* formed in the transparent window 210 engages with the first stopper 132 formed in the upper body 130, and the moving body 200 slidably moves with respect to the body 100, the transparent window 210 of the moving body 200 may be restricted from excessively moving in front of the front end of the upper body 130.

In the shoe care device 1 according to an embodiment of the present disclosure, the transparent window 210 may include a first window 211 forming the front surface, a second window 212 forming the left surface, and a third window 213 forming the right surface, and the first window 211, the second window 212, and the third window 213 may be integrally formed.

That is, the transparent window 210 may be formed in a bent shape to form three surfaces. Accordingly, the transparent window 210 may have an overall "⊏" shape in the plan view.

In particular, the transparent window 210 may be formed integrally without support members such as separate frames in the portions where the first window 211, the second window 212, and the third window 213 are connected.

As described above, since the shoe care device 1 according to the present embodiment includes the first window 211, the second window 212, and the third window 213 of the transparent window 210, which are integrally formed without support members such as separate frames in the connection portions, it may provide visual unity and openness.

In the shoe care device 1 according to an embodiment of the present invention, the second fin portion 213*a* of which a part is projected upward may be formed at the upper portion of the part forming the other side surface of the accommodation space 10 in the transparent window 210.

In addition, the stopping part 130*s* may be configured to further include a second stopper 134 which is formed on the other side surface of the upper body 130 spaced apart from the front end of the upper body 130, and engages with the second fin portion 213*a* upon the sliding movement of the moving body 200 with respect to the body 100.

In this case, the first stopper 132 and the second stopper 134 may be formed to be symmetric to each other.

That is, the first fin portion 212*a* and the second fin portion 213*a* are formed to protrude upward from the rear ends of the second window 212 and the third window 213, and as a result, the accommodation space 10 may be maximally opened within a range in which the moving body 200 is not separated from the body 100.

In particular, the first fin portion 212*a* and the second fin portion 213*a* may be formed as a pair which are symmetric to each other in the left and right direction of the transparent window 210, and the first stopper 132 and the second stopper 134 corresponding to the first fin portion 212*a* and the second fin portion 213*a* may also be formed as a pair which are symmetric to each other in the left and right direction of the upper body 130.

Therefore, the second window 212 and the third window 213 of the transparent window 210 may be uniformly moved in the processing of the sliding movement of the moving body 200, and locations of the second window 212 and the third window 213 may be symmetric to each other in the opened state of the shoe care device 1.

As such, in the shoe care device 1 according to the embodiment, since the first stopper 132 and the second stopper 134 are formed on both side surfaces to be symmetric to each other, the moving body 200 may be uniformly moved without being twisted upon the sliding movement of the moving body 200 with respect to the body 100.

In the shoe care device 1 according to an embodiment of the present invention, a hooking portion 227 which protrudes inward may be formed on the side surface of the base 220, and the stopping part 130*s* may further include a hooking groove 117 which is formed on the side surface of the lower body 110 spaced apart from the front end of the lower body 110, and engages with the hooking portion 227 upon the sliding movement of the moving body 200 with respect to the body 100.

That is, the hooking portion 227 which protrudes inward may be formed on the side surface of the base 220 which is slidably movable with respect to the lower body 110. The hooking portion 227 may maintain the engaged state with the hooking groove 117 formed on the side surface of the lower body 110.

Therefore, in the process in which the shoe care device 1 is switched to the closed state and the opened state, the hooking portion 227 of the base 220 may be slidably moved while engaging with the hooking groove 117 of the lower body 110.

As a result, a left-right direction clearance between the base 220 and the body 100 may be appropriately prevented in the process of the sliding movement of the moving body 200 with respect to the body 100.

Further, since the hooking groove 117 is formed only up to the portion spaced apart from the front end of the lower body 110, a range of the hooking portion 227 engaging with the hooking groove 117, which may move to the front of the body 100 may be restricted.

Meanwhile, the shoe care device 1 may be configured to include a first slider holder to which a first slider is fixed and a second slider holder to which a second slider is fixed. The first slider holder may be configured integrally with the first slider. The second slider holder may be configured integrally with the second slider.

When the closed state of the shoe care device 1 is switched to the opened state, the second slider holder may be configured to be hooked to the first slider holder if the second slider holder moves forward. As a result, the first slider holder and the second slider holder may also serve as the hooking portion 227 and the hooking groove 117.

As such, in the shoe care device 1 according to the embodiment, since the hooking portion 227 formed in the base 220 engages with the hooking groove 117 formed in the lower body 110, and the moving body 200 slidably moves with respect to the body 100, the base 220 of the moving body 200 may be restricted from excessively moving in the front of the front end of the lower body 110.

In the shoe care device 1 according to an embodiment of the present invention, the hooking portion 227 may be formed as a pair which are symmetric to both side surfaces of the rear end of the base 220, and the hooking groove 117 may be formed as a pair which are symmetric to both side surfaces of the lower body 110.

That is, the hooking portion 227 is formed to be projected from the rear end of the base 220, so the accommodation space 10 may be maximally opened within the range in which the moving body 200 is not separated from the body 100.

In particular, the hooking portion 227 may be formed as a pair which are symmetric in the left and right direction of the base 220, and the hooking groove 117 corresponding to the hooking portion 227 may also be formed as a pair which are symmetric in the left and right direction of the lower body 110.

Therefore, the left and right side surfaces of the base 220 may be uniformly moved in the process of the sliding movement of the moving body 200, and left and right side surface locations of the base 220 may be symmetric to each other in the opened state of the shoe care device 1.

As such, in the shoe care device 1 according to the embodiment, since the hooking portion 227 and the hooking groove 117 are formed on both side surfaces, respectively as a pair which are symmetric, the moving body 200 may be uniformly moved without being twisted upon the sliding movement of the moving body 200 with respect to the body 100.

In the shoe care device 1 according to an embodiment of the present disclosure, the moving body 200 may be coupled to the base 220 to rotate about a vertical axis, and may further include a turntable 230 forming the lower surface of the accommodation space 10 together with the base 220.

That is, the turntable 230 may form a seating surface on which shoes are placed in the accommodation space 10 and may be configured to rotate relative to the base 220 at the bottom of the moving body 200. Accordingly, when the turntable 230 rotates, the shoe placed on the upper surface of the turntable 230 may be rotated together.

As described above, in the shoe care device 1 according to this embodiment, the turntable 230 may be disposed on the lower surface of the accommodation space 10 to rotate about the vertical axis, so that the shoes may be displayed while rotating and air may flow in various directions with respect to the shoes, enabling uniform care for each entire shoe.

In the shoe care device 1 according to an embodiment of the present invention, the rotational axis 231 of the turntable 230 may be positioned in front of the front end of the body 100 based on the state in which the moving body 200 is at the second location.

That is, the location of the moving body 200 which slidably moves from the body 100 in the opened state of the shoe care device 1 may be set by comparing the rotational axis 231 of the turntable 231 and the front end of the body 100.

In that the rotational axis 231 of the turntable 230 which axially rotates is substantially in proximity to or coincides with the center of the plane of the base 220, the state in which the rotational axis 231 of the turntable 230 is positioned in front of the front end of the body 100 may be a state in which a half or more of the accommodation space 10 is opened. Therefore, the state may be a state in which the accommodation space 10 for storing and withdrawing the shoe is sufficiently opened.

As such, in the shoe care device 1 according to the embodiment, since the rotational axis 231 of the turntable 230 is positioned in front of the front end of the body 100 in the opened state, sufficient opening for storing and withdrawing the shoe may be made while maintaining a stable state in the opening process of the accommodation space 10.

The shoe care device 1 according to an embodiment of the present invention may further include a frame body coupled to the body 100 in a shape connecting the upper body 130, the lower body 110, and the middle body 120 to support the upper body 130, the lower body 110, and the middle body 120.

As such, in the shoe care device 1 according to the embodiment, since the frame body is coupled to the body 100 in a shape connecting the upper surface, the lower surface, and the rear surface of the body 100 to support the body 100, the shoe care device 1 may maintain a stable state by reinforcing a structural vulnerable part in the body 100.

In the shoe care device 1 according to an embodiment of the present invention, the frame body may include an upper frame coupled to the upper body 130, a lower frame coupled to the lower body 110, and a middle frame connecting rear sides of the upper frame and the lower frame and coupled to the middle body 120.

In this case, the upper frame, the lower frame, and the middle frame may be formed by bending one member which is formed to extend in a longitudinal direction.

As such, in the shoe care device 1 according to the embodiment, since the frame body including the upper frame, the lower frame, and the middle frame is formed by bending one member which is formed to extend in the longitudinal direction, the frame body may be easily manufactured, and a cutting surface of the frame body corresponding to a reinforcing member may be minimized.

Figure 8:
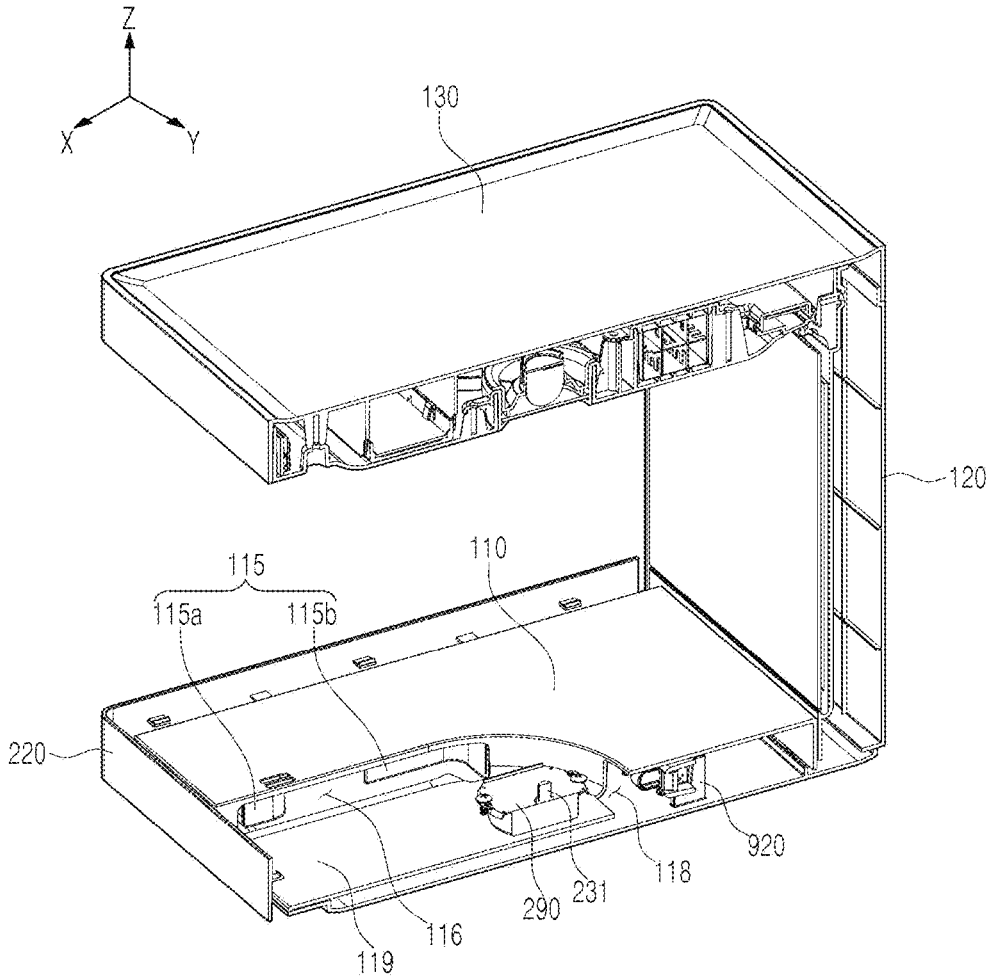
FIG. 8 is a diagram illustrating a cross-section state of some components of the shoe care device according to an embodiment of the present invention.
Figure 9:
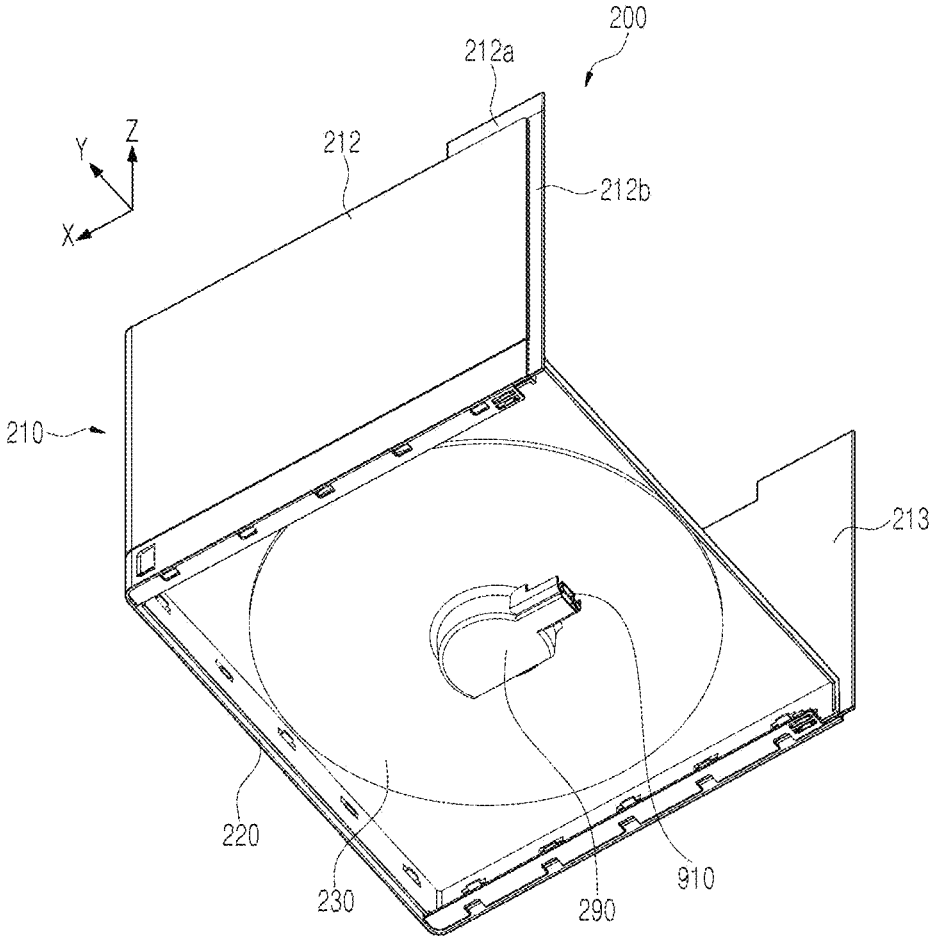
FIG. 9 is a diagram illustrating the bottom of the moving body in the shoe care device according to an embodiment of the present invention.
Figure 10:
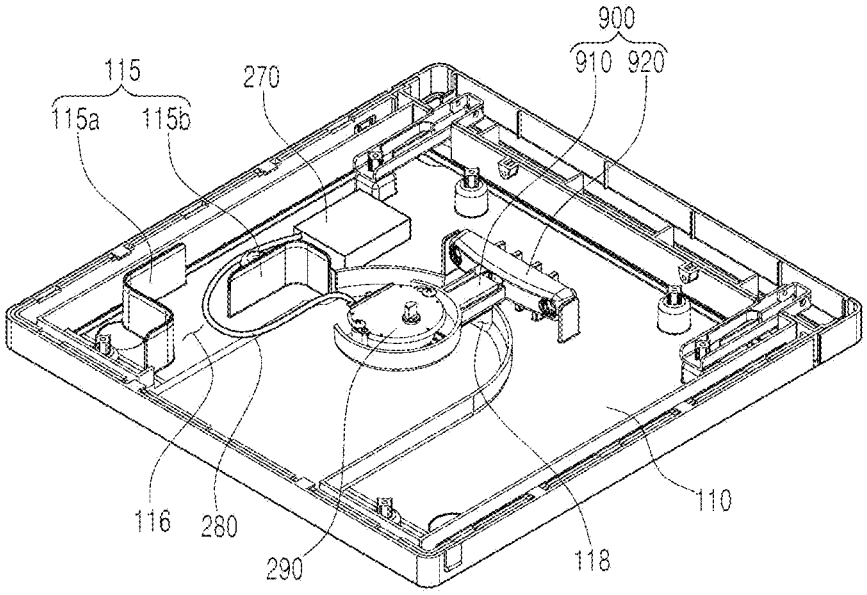
FIG. 10 is a diagram illustrating placement of the motor and a cable in the closed state of the shoe care device according to an embodiment of the present invention.
Figure 11:
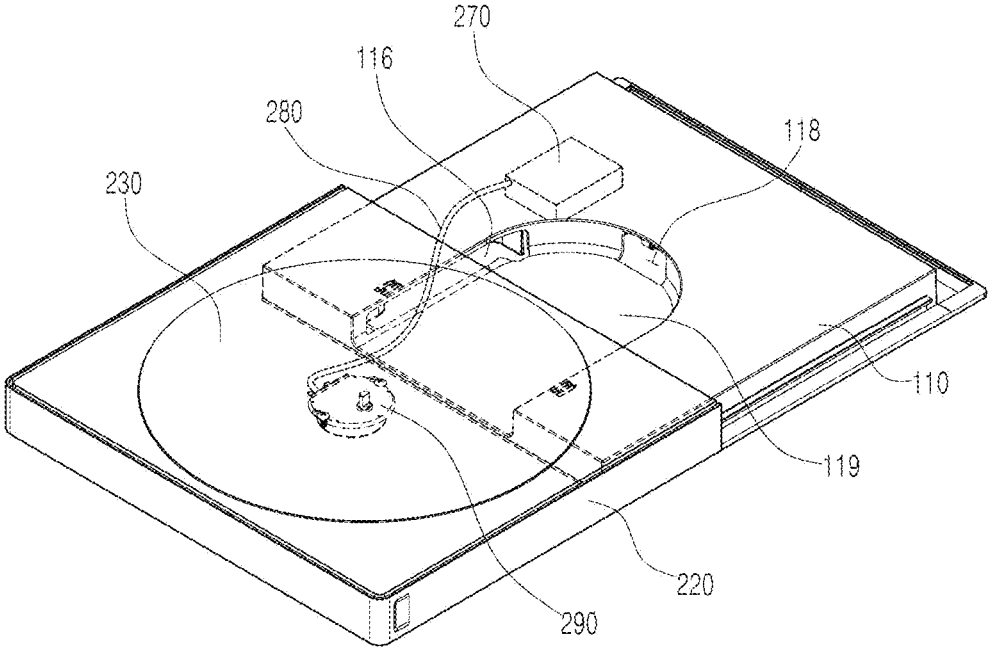
FIG. 11 is a diagram illustrating the placement of the motor and the cable in the opened state of the shoe care device according to an embodiment of the present invention.

FIG. 8 is a diagram illustrating a cross-section state of some components of the shoe care device 1 according to an embodiment of the present invention. FIG. 9 is a diagram illustrating the bottom of the moving body 200 in the shoe care device 1 according to an embodiment of the present invention. FIG. 10 is a diagram illustrating placement of the motor 290 and a cable 280 in the closed state of the shoe care device 1 according to an embodiment of the present invention. FIG. 11 is a diagram illustrating the placement of the motor 290 and the cable 280 in the opened state of the shoe care device 1 according to an embodiment of the present invention.

According to an embodiment of the present invention, the shoe care device 1 may include the body 100, the moving body 200, and the blowing part 330.

The body 100 as a part that forms a part of the accommodation space 10 may constitute a reference location for the moving body 200 which slidably moves.

The moving body 200 is a part that forms the accommodation space 10 jointly with the body 100, and is coupled to the body 100 to slidably move between the first location and the second location in front of the first location.

The blowing part 330 as a part configured to circulate the air in the accommodation space 10 may allow the shoe accommodated in the accommodation space 10 to be paced in an appropriate environment by adjusting an air state (in particular, humidity) of the accommodation space 10.

In this case, the body 100 may be configured to include the lower body 110 positioned below the accommodation space 10, and having the lower body groove 119 having a shape in which the front side is opened.

In addition, the moving body 200 may be configured to include the base 220 slidably coupled to the lower body 110, the turntable 230 rotatably coupled to the base 220 around the vertical axis, and forming the bottom of the accommodation space 10 jointly with the base 220, and the motor 290 placed in the lower body groove 119 and coupled to apply the rotational force to the turntable 230.

That is, the lower body groove 119 which is concave downward and opened forward is formed at the central portion of the lower body 110 to prevent interference with the body 100 in the process of the sliding movement of the moving body 200.

In particular, the motor 290 also needs to be coupled to the base 220 in order to rotate the turntable 230 coupled to the base 220 of the moving body 200, and it may be preferable to place the motor 290 below the base 220 in appearance.

Therefore, when the motor 290 is placed below the base 220, it may be more preferable to place the motor 290 at the lower body groove 119 so as to prevent the motor 290 from interfering with the body 100 in the process of the sliding movement of the moving body 200.

As such, in the shoe care device 1 according to the embodiment, since the motor 290 applying the rotational force to the turntable 230 is placed at the lower body groove 119 formed in the lower body 110, the motor 290 may be prevented from interfering in the body 100 in the process of the sliding movement of the moving body 200.

The shoe care device 1 according to an embodiment of the present invention may further include the heating part 340 configured to heat the circulated air in the accommodation space 10 to appropriately maintain the environment of the accommodation space 10, thereby more effectively caring the shoe.

The shoe care device 1 according to an embodiment of the present invention may further include the power supply 270 which is placed at a portion other than the lower body groove 119 in the lower body 110, and the cable 280 electrically connecting the motor 290 and the power supply 270.

In this case, a side entrance 116 of which a part is opened is formed at a side of the lower body groove 119, so the cable 280 may connect the motor 290 and the power supply 270 through the side entrance 116.

As such, the motor 290 needs to be coupled to the base 220. When the power supply 270 supplying the power to the motor 290 is also coupled to the base 220, the structure of the moving body 200 becomes complicated, and a weight also increases, so the sliding movement of the moving body 200 may be difficult.

Therefore, even though the motor 290 is coupled to the base 220, it may be preferable that the power supply 270 is placed, and the motor 290 and the power supply 270 are connected by a flexible cable 280.

In this case, the power supply 270 may also be placed at the lower body groove 119, but the lower body groove 119 also needs to be formed to be larger in order to place the power supply 270 occupying a predetermined space. However, in that when the lower body groove 119 is formed to be excessively large, the rigidity of the lower body 110 may be lowered, it may be preferable to minimize the size of the lower body groove 119.

Further, it is preferable that the power supply 270 is placed relatively on an outer portion of the lower body 110 in order to facilitate connection with an external power supply.

Further, since it is preferable to preferentially place the member which needs to be installed in the base 220 and coupled to the lower body 110 at the lower body groove 119, it may be more preferable to place the power supply 270 at a portion of the lower body 110 other than the lower body groove 119.

In addition, in order to connect the power supply 270 placed at the portion other than the lower body groove 119 and the motor 290 placed at the lower body groove 119, the side entrance 116 is formed on the side of the lower body groove 119 and the cable 280 may be inserted into the side entrance 116.

As described above, since it is preferable that the rear entrance 118 for fastening the locking body 900 is formed on the rear side of the lower body groove 119, it may be preferable that the side entrance 116 for placement of the cable 280 is placed on the side of the lower body groove 119.

As such, in the shoe care device 1 according to the embodiment, since the cable 280 connects the motor 290 and the power supply 270 through the side entrance 116 formed on the side of the lower body groove 119, the motor 290 and the power supply 270 may be smoothly connected while stably placing the power supply 270 in the lower body 110.

In the shoe care device 1 according to an embodiment of the present invention, a guide wall 115 guiding a movement section of the cable 280 crossing the side entrance 116 may be formed in the lower body 110.

When the moving body 200 moves forward and backward with respect to the body 100, the cable 280 connecting the power supply 270 and the motor 290 needs to be transformed to a predictable form while moving in an allowed section.

As a result, it may be preferable that the guide wall guiding the movement section of the cable 280 is formed in the lower body 110 to prevent the damage to the cable 280 and achieve a stable operation when the moving body 200 moves with respect to the body 100.

In this case, the guide wall 115 may be configured to be projected upward on the bottom of the lower body 110, and formed at a plurality of continuous or intermittent locations.

As such, in the shoe care device 1 according to the embodiment, since the movement section of the cable 280 is guided through the guide wall 115 formed in the lower body 110, the cable 280 may be prevented from being damaged or separated in the process of the sliding movement of the moving body 200.

In the shoe care device 1 according to an embodiment of the present invention, the guide wall 115 may be configured to include a first guide barrier 115*a* placed at the front side of the side entrance 116 and a second guide barrier 115*b* placed at the rear side of the side entrance 116.

The first guide barrier 115*a* and the second guide barrier 115*b* may be configured to be projected upward on the bottom of the lower body 110, and formed to be spaced apart from each other. In addition, the cable 280 may be placed between the first guide barrier 115*a* and the second guide barrier 115*b*. That is, a gap may be formed between the first guide barrier 115*a* and the second guide barrier 115*b*, and the cable 280 may connect the motor 290 and the power supply 270 through the gap.

In particular, since the first guide barrier 115*a* and the second guide barrier 115*b* are formed to cover the front side and the rear side of the side entrance 116 except for only the gap for connecting the cable 280, the first guide barrier 115*a* and the second guide barrier 115*b* may partially prevent foreign substances from passing through the side entrance 116.

As such, in the shoe care device 1 according to the embodiment, since the guide wall 115 is configured to include the first guide barrier 115*a* and the second guide barrier 115*b*, the guide wall 115 may partially prevent foreign substances from being introduced into the lower body 110 other than the lower body groove 119.

In the shoe care device 1 according to an embodiment of the present invention, the second guide barrier 115*b* may be formed to extend to the front of the location of the motor 290 based on the state in which the moving body 200 is at the first location.

That is, the second guide barrier 115*b* may be formed to extend to the front of the location of the motor 290 in the closed state of the shoe care device 1.

The motor 290 which is driven primarily in the closed state of the shoe care device 1 may generate vibration depending on kinetic energy, and foreign substances which are present around the motor 290 may be scattered.

Therefore, it may be preferable that the second guide barrier 115*b* blocks the placement location of the motor 290 in the closed state to prevent the foreign substances from being directly introduced into the side entrance 116.

As such, in the shoe care device 1 according to the embodiment, since the second guide barrier 115*b* is formed to extend to the front of the location of the motor 290 in the closed state, the foreign substances scattered by the driving of the motor 290 may be minimized from being introduced into the lower body 110 other than the lower body groove 119.

In the shoe care device 1 according to an embodiment of the present invention, the first guide barrier 115*a* may be formed to extend in a shape in which a part is bent toward the side surface of the lower body 110 from the front side of the side entrance 116.

That is, a part of the first guide barrier 115*a* may cover the front side of the side entrance 116, and may be formed to extend toward the side surface of the lower body 110 from the part. In addition, a part of the extending first guide barrier 115*a* is formed to be bent, and as a result, a gap in the front and rear direction and a gap in the left and right direction from the second guide barrier 115*b* may be formed.

As a result, the cable 280 connecting the power supply 270 and the motor 290 may be stably placed at the gap between the first guide barrier 115*a* and the second guide barrier 115*b*.

As such, in the shoe care device 1 according to the embodiment, since the first guide barrier 115*a* is formed to extend up to the side surface of the lower body 110 from the front side of the side entrance 116 in the shape in which a part is bent, the cable 280 may be stably placed through gaps in the front and rear direction and the left and right direction between the first guide barrier 115*a* and the second guide barrier 115*b*.

In the shoe care device 1 according to an embodiment of the present invention, a bent portion of the first guide barrier 115*a* may be configured to include the curved surface.

The shape and the location of the cable 280 may be changed in the process of the sliding movement of the moving body 200, and the cable 280 may hit the first guide barrier 115*a* and the second guide barrier 115*b*. In this case, if the bent portion of the first guide barrier 115*a* is sharp, there is a risk that the cable 280 will be damaged.

Therefore, it may be preferable that the bent portion of the first guide barrier 115*a* is formed by the curve surface to prevent the first guide barrier 115*a* from damaging the cable 280 even though the cable 280 contacts the first guide barrier 115*a*.

As such, in the shoe care device 1 according to the embodiment, since the bent portion of the first guide barrier 115*a* is formed in the curved surface shape, it is possible to minimize the cable 280 from being damaged due to the contact with the first guide barrier 115*a* in the process of the sliding movement of the moving body 200.

In the shoe care device 1 according to an embodiment of the present invention, since the body 100 may further include the upper body 130 forming the top of the accommodation space 10 and the middle body 120 forming the rear surface of the accommodation space 10 by connecting the rear sides of the upper body 130 and the lower body 110, and the moving body 200 may further include the transparent window 210 which extends upward on the base 220 and forms the front surface and the both side surfaces of the accommodation space 10, the connection structure of the body 100 and the moving body 200 may be stably maintained in the process of the sliding movement of the moving body 200 with respect to the body 100.

In the shoe care device 1 according to an embodiment of the present invention, since the transparent window 210 includes the first window 211 forming the front surface, the second window 212 forming the left surface, and the third window 213 forming the right surface, and the first window 211, the second window 212, and the third window 213 may be integrally formed, the support member such as the separate frame is not interposed between the connection portions to provide the sense of unity and the sense of opening visually.

The shoe care device 1 according to an embodiment of the present invention may further include the locking body 900 configured to lock the sliding movement of the moving body 200 with respect to the body 100.

In this case, since the locking body 900 may include the locking lever 910 installed in the base 220 and placed at the lower body groove 119, and the locking holder 920 installed in the lower body 110 and fastened to the locking lever 910 alternatively when being pressed by the locking lever 910, the closed state and the opened state may be stably and easily switched.

In the shoe care device 1 according to an embodiment of the present invention, the locking holder 920 is placed in the rear of the lower body groove 119 and the rear entrance 118 for exposing the locking holder 920 is formed at the rear side of the lower body groove 119, and as a result, the locking lever 910 may be fastened to the locking holder 920 through the rear entrance 118. Therefore, even though the lower body groove 119 is not formed to be excessively large, the locking lever 910 and the locking holder 920 may be smoothly fastened.

Hereinabove, a specific embodiment of the present disclosure is described and illustrated, but the present invention is not limited to the disclosed embodiment, and it may be appreciated by those skilled in the art that the embodiment can be variously modified and transformed to another specific embodiment without departing from the spirit and the scope of the present invention. Therefore, the scope of the present disclosure will not be defined by the described embodiment, but defined by the technical spirit disclosed in the claims.

INDUSTRIAL APPLICABILITY

According to at least one of the embodiments of the present disclosure, since the shoes are accommodated in the accommodation space formed by both the body and the moving body and then switch to a closed state to display the shoes, and since the air in the accommodation space is circulated by the blowing part to adjust the condition of the accommodation space, it is possible to effectively realize both the shoe display effect and shoe management effect.

In addition, according to at least one of the embodiments of the present disclosure, since the moving body, which is slidably coupled to the body, moves between the first location and the second location to open and close the accommodation space, the placement and removal of the shoes may be effectively performed.

In addition, according to at least one of the embodiments of the present disclosure, since the sliding movement of the moving body relative to the body is limited to not exceed the second location by the stopping part, it is possible to prevent the body and the moving body from separating or overturning due to a change in the center of gravity when the moving body is moved too much in the open state.

In addition, according to at least one of the embodiments of the present disclosure, since the condition of the accommodation space is adjusted by heating the air in the accommodation space by the heating part, it is possible to appropriately maintaining the environment of the accommodation space, enabling more effective shoe management.

In addition, according to at least one of the embodiments of the present disclosure, since the body includes the upper body, the lower body, and the middle body and since the moving body includes a base and a transparent window, the connection structure between the body and the moving body may be maintained stably in the sliding movement process of the moving body relative to the body.

In addition, according to at least one of the embodiments of the present disclosure, since the first fin portion formed in the transparent window engages with the first stopper formed in the upper body such that the moving body slides relative to the body, it is possible to prevent the transparent window of the moving body from excessively moving forward of the front end of the upper body.

In addition, according to at least one of the embodiments of the present disclosure, since the first window, the second window, and the third window of the transparent window are formed integrally without support members such as separate frames provided in the connecting portions, it is possible to provide visual unity and openness.

In addition, according to at least one of the embodiments of the present disclosure, since the first stopper and the second stopper are formed symmetrically on both sides, when the moving body slides relative to the body, the transparent window may move uniformly without being distorted.

In addition, according to at least one of the embodiments of the present disclosure, since the hooking portion formed on the base engages with the hooking groove formed on the lower body so that the moving body slides relative to the body, it is possible to prevent the base of the moving body from excessively moving forward of the front end of the lower body.

In addition, according to at least one of the embodiments in the present disclosure, since the hooking portion and the hooking groove are formed as a symmetrical pair on both sides, the base may be moved uniformly without being distorted when the moving body slides relative to the body.

In addition, according to at least one of the embodiments of the present disclosure, since the turntable is disposed on the lower surface of the accommodation space and rotates about a vertical axis, the shoes may be displayed while rotating and air may flow in various directions with respect to the shoes, enabling uniform care for each entire shoe.

In addition, according to at least one of the embodiments in the present disclosure, since the rotation axis of the turntable is located in front of the front end of the body in the open state, the accommodation space may be maintained in a stable state during the opening process and may be sufficiently open for placing and removing the shoes.

In addition, according to at least one of the embodiments in the present disclosure, the frame body may be coupled to the body in a shape that connects the upper surface, the lower surface, and the rear surface of the body to support the body, thereby strengthening structurally weak parts of the body so that the shoe care device is maintained in a stable state.

In addition, according to at least one of the embodiments of the present disclosure, since the frame body including the upper frame, the lower frame, and the middle frame is formed by bending one member formed to extend in the longitudinal direction, it is easy to manufacture the frame body and minimize the cut surface of the frame body corresponding to the reinforcement member.

The invention claimed is:

1. A shoe care device comprising:

an accommodation space to accommodate shoes therein;

a first body;

a second body, the second body slidably coupled to the first body to move between a first position and a second position, the first body and the second body defining the accommodation space when the second body is in the first position;

a blower configured to circulate air in the accommodation space; and a stopper configured to limit sliding movement of the second body relative to the first body at the second position, wherein the first body comprises:

an upper body defining an upper surface of the accommodation space;

a lower body located below the accommodation space; and a middle body connecting rear sides of the upper body and the lower body, the middle body defining a rear surface of the accommodation space, and wherein the second body comprises:

a base slidably coupled to the lower body;

a transparent window extending upward from an upper part of the base, the transparent window defining a front surface of the accommodation space, a first side surface of the accommodation space, and a second side surface of the accommodation space opposite the first side surface of the accommodation space; and a turntable coupled to the base, the turntable being configured to rotate about a vertical axis, the turntable and the base defining a lower surface of the accommodation space.

2. The shoe care device according to claim 1, further comprising a heater configured to heat the air circulating in the accommodation space.

3. The shoe care device according to claim 1, wherein the first side surface includes a first fin portion extending upward at an upper portion of the first side surface of the accommodation space, and wherein the stopper comprises a first stopper located on a first side surface of the upper body and spaced apart from a front end of the upper body, the first stopper being configured to engage with the first fin portion upon the sliding movement of the second body relative to the first body.

4. The shoe care device according to claim 3, wherein the transparent window comprises a front window defining the front surface, a first side window defining the first side surface, and a second side window defining the second side surface, and wherein the front window, the first side window, and the second side window are integrally formed.

5. The shoe care device according to claim 4, wherein the second side surface includes a second fin portion extending upward at an upper portion of the second side surface of the accommodation space, wherein the stopper further comprises a second stopper located on a second side surface of the upper body and spaced apart from the front end of the upper body, the second stopper being configured to engage with the second fin portion upon the sliding movement of the second body relative to the first body, and wherein the first stopper and the second stopper are symmetrically arranged.

6. The shoe care device according to claim 5, wherein the base includes a hooking portion protruding upward at a side surface of the base, and wherein the stopper further comprises a hooking groove located on a side surface of the lower body and spaced apart from a front end of the lower body, the hooking groove being configured to engage with the hooking portion upon the sliding movement of the second body relative to the first body.

7. The shoe care device according to claim 6, wherein the hooking portion is provided as a pair of hooking portions symmetrically located at opposite side surfaces of a rear portion of the base, and wherein the hooking groove is provided as a pair of hooking grooves symmetrically located at opposite side surfaces of the lower body.

8. The shoe care device according to claim 3, wherein the second side surface includes a second fin portion extending upward at an upper portion of the second side surface of the accommodation space, wherein the stopper further comprises a second stopper located on a second side surface of the upper body and spaced apart from the front end of the upper body, the second stopper being configured to engage with the second fin portion upon the sliding movement of the second body relative to the first body, and wherein the first stopper and the second stopper are symmetrically arranged.

9. The shoe care device according to claim 3, wherein the base includes a hooking portion protruding upward at a side surface of the base, and wherein the stopper further comprises a hooking groove located on a side surface of the lower body and spaced apart from a front end of the lower body, the hooking groove being configured to engage with the hooking portion upon the sliding movement of the second body relative to the first body.

10. The shoe care device according to claim 9, wherein the hooking portion is provided as a pair of hooking portions symmetrically located at opposite side surfaces of a rear portion of the base, and wherein the hooking groove is provided as a pair of hooking grooves symmetrically located at opposite side surfaces of the lower body.

11. The shoe care device according to claim 1, wherein the base includes a hooking portion protruding upward at a side surface of the base, and wherein the stopper further comprises a hooking groove located on a side surface of the lower body and spaced apart from a front end of the lower body, the hooking groove being configured to engage with the hooking portion upon the sliding movement of the second body relative to the first body.

12. The shoe care device according to claim 1, wherein, when the second body is in the second position, a rotational axis of the turntable is located in front of a front end of the first body.

13. The shoe care device according to claim 12, further comprising a motor configured to rotate the turntable, wherein the lower body includes a groove configured to receive the motor.

14. The shoe care device according to claim 13, wherein the motor is configured to slide in the groove of the lower body as the second body moves between the first position and the second position.

* * * * *